US006023818A

United States Patent [19]

Shang

[11] Patent Number: 6,023,818

[45] Date of Patent: Feb. 15, 2000

[54] SPRING-BIASED CLIP MECHANISM

[76] Inventor: Chen Shui Shang, 199 Su Mau Road, Ho Mei Township, Chan Hua Hsien, Taiwan

[21] Appl. No.: 09/031,117

[22] Filed: Feb. 26, 1998

[51] Int. Cl.[7] ..... A44B 21/00

[52] U.S. Cl. ..... 24/501; 24/507; 24/511

[58] Field of Search ..... 24/501, 511, 510, 24/500, 507, 566, 561, 562, 564; 223/90, 91, 93, 95

[56] References Cited

U.S. PATENT DOCUMENTS 2,200,624 5/1940 Jones ..... 24/501 X
4,077,092 3/1978 Basevi ..... 24/501 X
4,660,750 4/1987 Blanchard ..... 24/501 X
5,402,558 4/1995 Santapa ..... 24/501 X

*Primary Examiner*—James R. Brittain
*Attorney, Agent, or Firm*—Harrison & Egbert

[57] ABSTRACT

A clothespin including two hand grip portions provided respectively with a projection for locating a shaft, a retaining slot for retaining a u-shaped spring, and a head portion having a spherical body for retaining a clamping plate in such a manner that the clamping plate is capable of slight motion. The shaft is provided with a round slot facing the head portion of the hard grip portions and is further provided at both longitudinal ends thereof with a flange capable of being retained by a retaining groove of the hand grip portions.

2 Claims, 5 Drawing Sheets

SPRING-BIASED CLIP MECHANISM

FIELD OF THE INVENTION

The present invention relates generally to an article holding device, and more particularly to a clothespin for fastening clothes on a clothesline.

BACKGROUND OF THE INVENTION

The conventional clothespin is generally defective in design in that it often fails to fasten clothes securely on a clothesline, and that it can not be easily positioned on the clothesline.

SUMMARY OF THE INVENTION

The primary objective of the present invention is to provide an improved clothespin free from the shortcomings of the prior art clothespin.

In keeping with the principle of the present invention, the foregoing objective of the present invention is attained by a clothespin comprising two hand grip portions, a shaft, a u-shaped spring, and two clamping plates. The shaft, the u-shaped spring and the two clamping plates are located between the two hand grip portions such that the shaft is held between the two arms of the u-shaped spring. The shaft is located by the projections and the arcuate recesses of the two hand grip portions. The two hand grip portions are joined together at the head portions thereof in conjunction with two clamping plates.

The features and the functions of the present invention will be more readily understood upon a thoughtful deliberation of the following detailed description of the present invention with reference to the accompanying drawings.

DETAILED DESCRIPTION OF THE INVENTION

Figure 1:
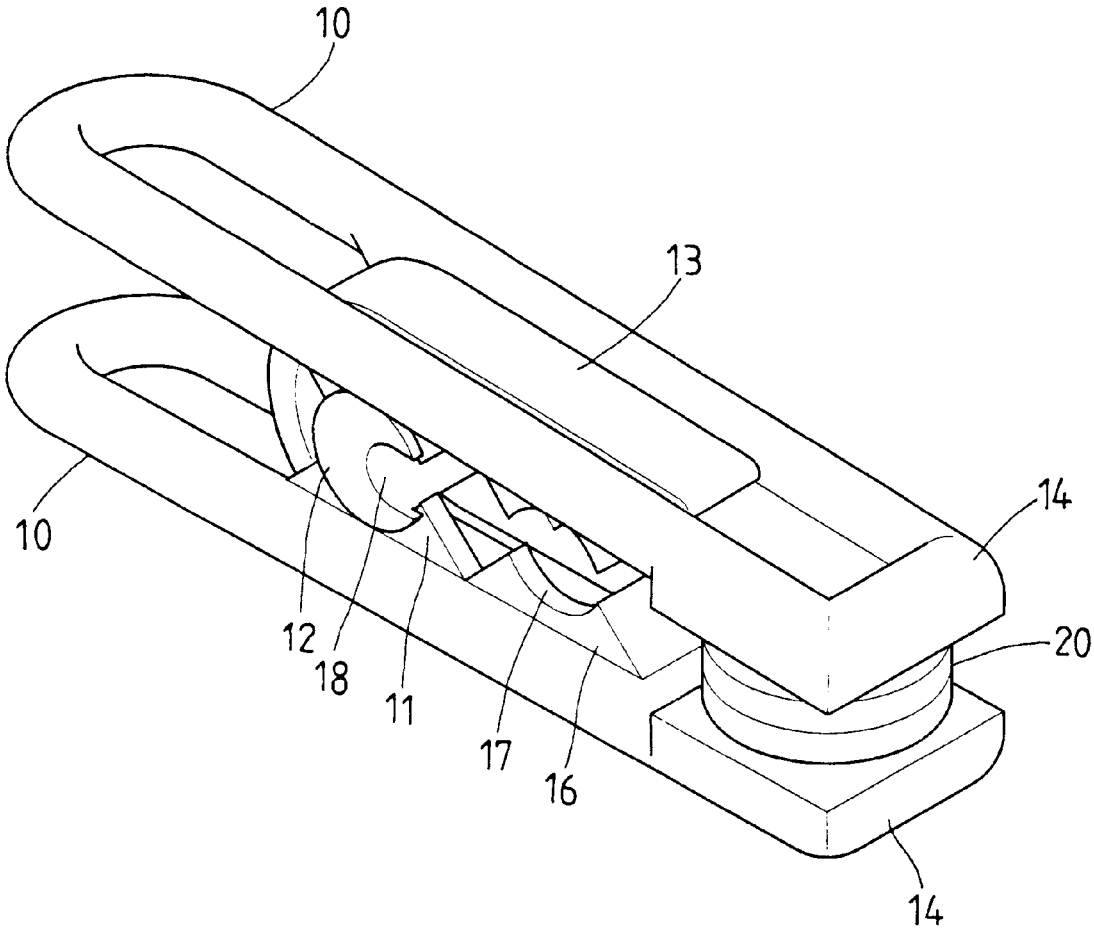
FIG. 1 shows a perspective view of the present invention.
Figure 2:
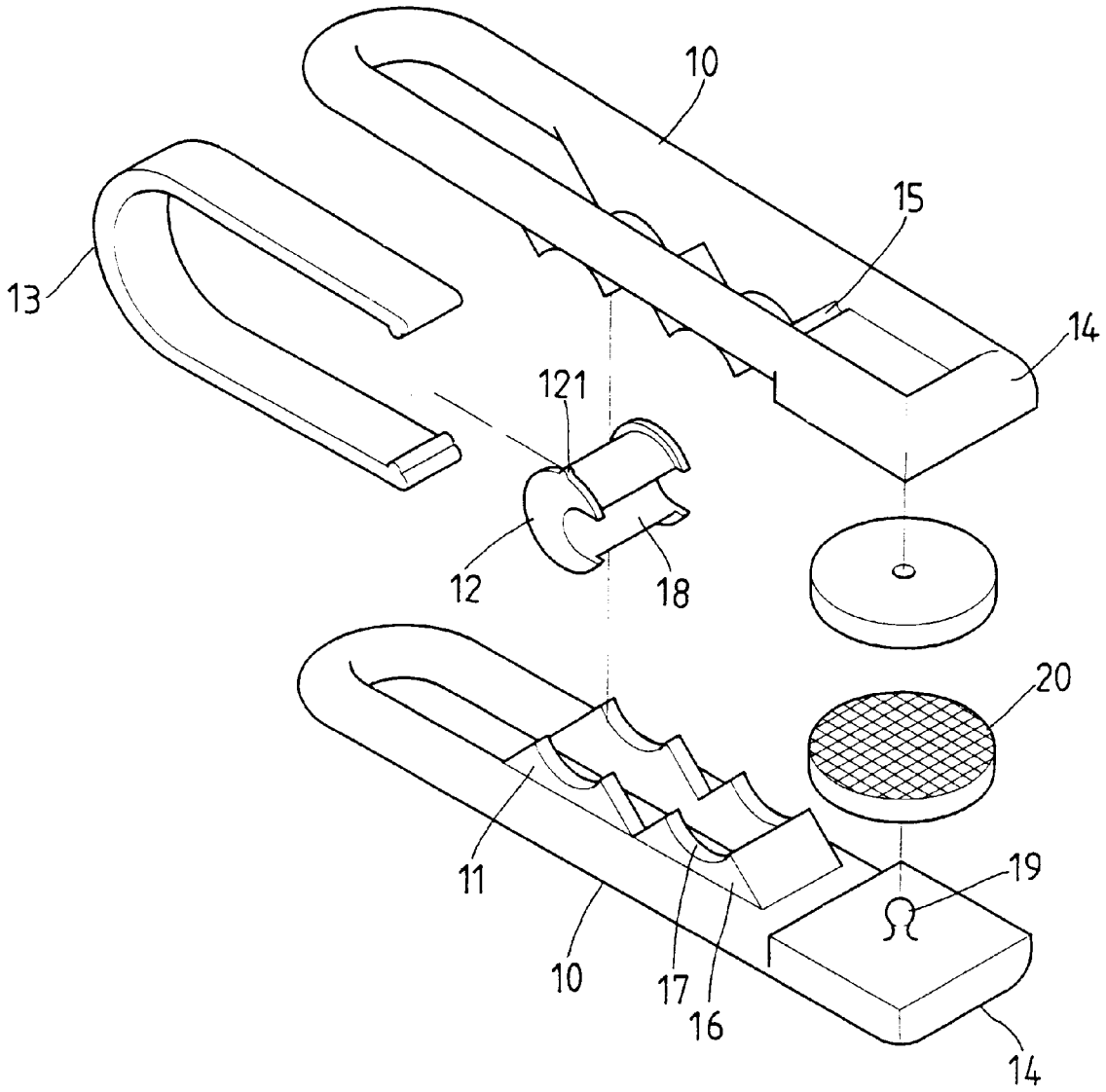
FIG. 2 shows an exploded view of the present invention.

As shown in FIGS. 1 and 2, a clothespin of the present invention is composed of two hand grip portions 10 which are provided respectively and oppositely in the midsection thereof with a projection 11 for holding together a shaft 12. A U-shaped spring 13 is held between the two hand grip portions 10 such that the spring 13 is retained by a retaining slot 15 of the hand grip portions 10. The hand grip portions 10 provided respectively and oppositely with a projection 16 and an arcuate recess 17 for locating the shaft 12. The shaft 12 is provided with a round slot 18 and is further provided respectively at both longitudinal ends thereof with a flange 121, which is retained by a retaining groove 101 of the hand grip portions 10 such that the round slot 18 of the shaft 12 faces the head portions 14 of the hand grip portions 10. The head portions 14 are provided respectively and oppositely with a retaining spherical body 19 for retaining a clamping plate 20 in such a manner that the clamping plate 20 is capable of pivoting slightly.

Figure 3:
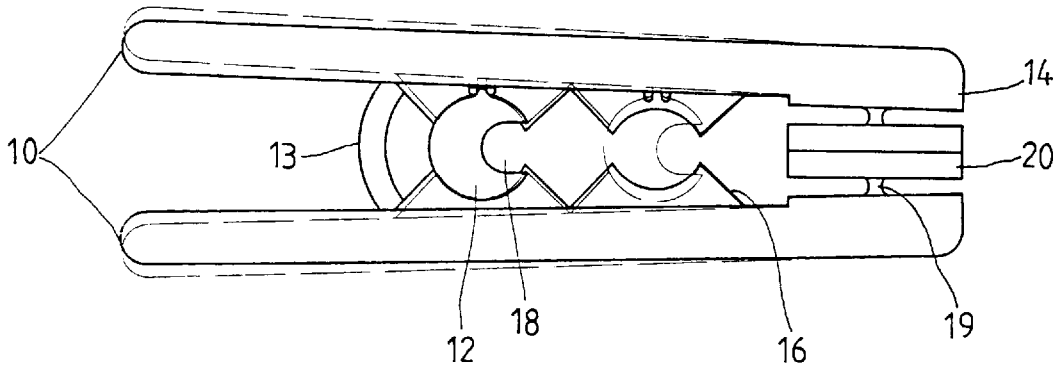
FIG. 3 shows a plan view of the shaft of the present invention.

As shown in FIGS. 2 and 3, the clamping force of the clothespin of the present invention can be adjusted by relocating the shaft 12 in the projections 11 and 16 such that the distance between the tail portions of the hand grip portions 10 and the shaft 12 is changed.

Figure 4:
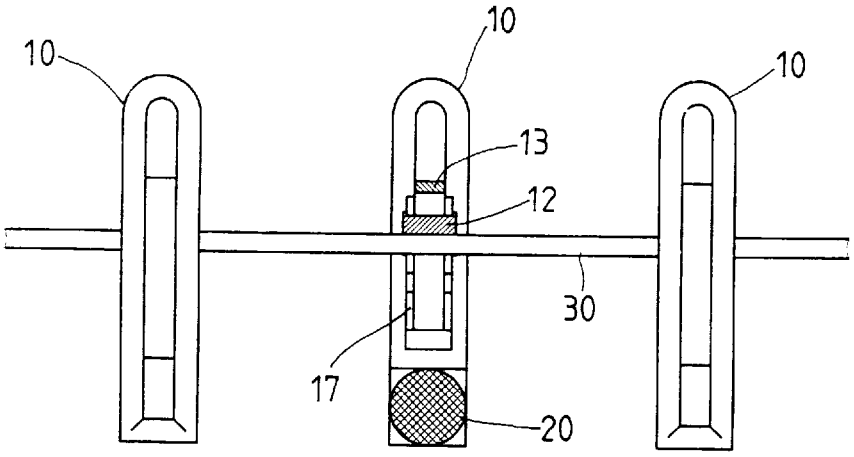
FIG. 4 shows a schematic view of the present invention in operation.

As shown in FIG. 4, the clothespin of the present invention is kept uprightly on a clothesline 30 which is received in the round slot 18 of the shaft 12. The head portions 14 of the hand grip portions 10 can be opened to allow the clothesline 30 to be received in the round slot 18 of the shaft 12.

Figure 5:
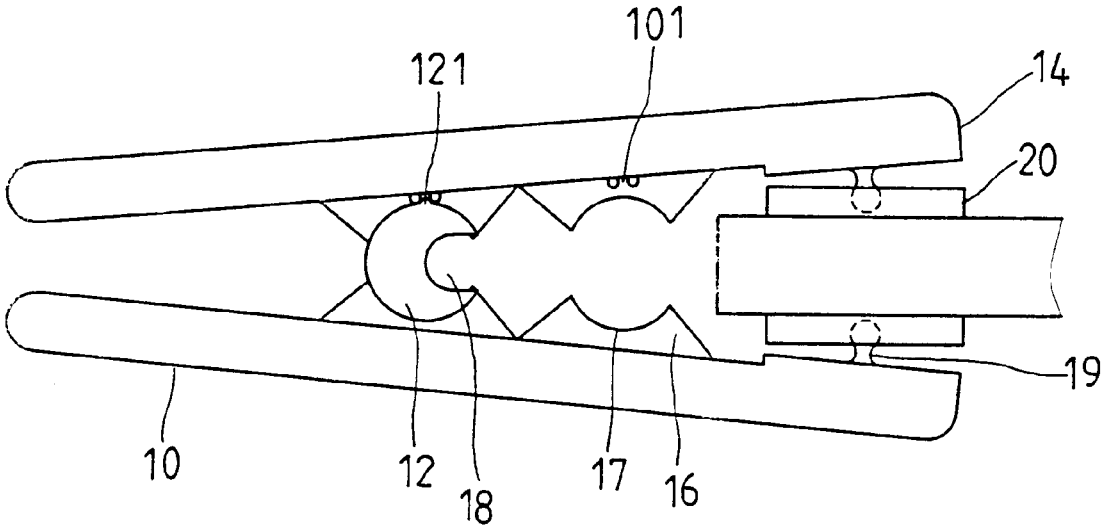
FIG. 5 shows another schematic view of the present invention.

As shown in FIG. 5, the head portions 14 of the hand grip portions 10 are provided respectively with the retaining spherical body 19 for holding the clamping plate 20 capable of slight pivoting motion. When an article is held by the head portions 14, the article is also held by the clamping plates 20.

Figure 6:
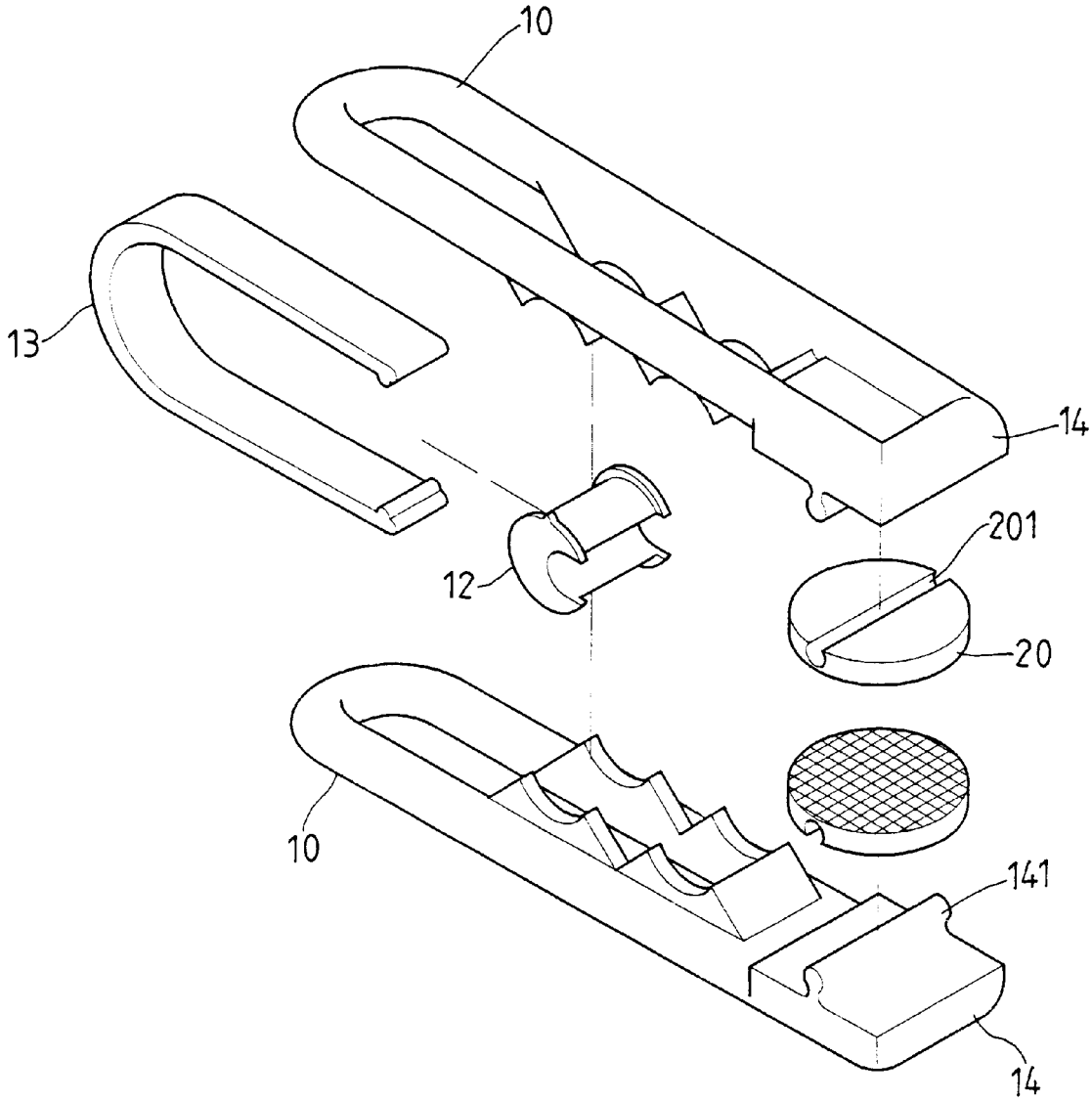
FIG. 6 shows an exploded view of another preferred embodiment of the present invention.

As shown in FIG. 6, the head portions 14 of the hand grip portions 10 are provided respectively with a rib 141, whereas the clamping plates 20 are provided respectively with a retaining slot 201, which is engaged with the rib 141 of the head portion 14 such that the clamping plate 20 is capable of slight motion.

The embodiments of the present invention described above are to be deemed in all respects as being merely illustrative and not restrictive. Accordingly, the present invention may be embodied in other specific forms without deviating from the spirit thereof. The present invention is thereofre to be limited only by the scopes of the following appended claims.

What is claimed is:

1. A clothespin in comprising two hand grip portions provided respectively and oppositely in a midsection thereof with a projection for receiving a shaft, each of said hand grip portions has a retaining slot retaining a U-shaped spring therein, said U-shaped spring being sandwiched between said two hand grip portions, said two hand grip portions being further provided respectively and oppositely with another projection and an arcuate recess receiving said shaft between said two hand grip portions, each of said hand grip portions having a head portion having a circular cross-section body retaining a clamping plate in a pivotable manner, said shaft having a round slot facing said head portion of said hand grip portions, said shaft having a flange at opposite ends thereof, said flange being retained by a retaining groove formed in said hand grip portions.

2. The clothespin of claim 1, wherein said circular cross-section body of said head portion of said two hand grip portions is a rib, said clamping plates being provided respectively with a retaining slot securely engaging said rib of said head portion.

* * * * *